US007546740B2

(12) United States Patent
Chen et al.

(10) Patent No.: US 7,546,740 B2
(45) Date of Patent: Jun. 16, 2009

(54) NOZZLE

(75) Inventors: Alexander G. Chen, Ellington, CT (US); Jeffrey M. Cohen, Hebron, CT (US)

(73) Assignee: United Technologies Corporation, Hartford, CT (US)

( * ) Notice: Subject to any disclaimer, the term of this patent is extended or adjusted under 35 U.S.C. 154(b) by 927 days.

(21) Appl. No.: 10/843,908

(22) Filed: May 11, 2004

(65) Prior Publication Data

US 2005/0252218 A1 Nov. 17, 2005

(51) Int. Cl.
*F02C 7/22* (2006.01)

(52) U.S. Cl. ..... 60/776; 60/746; 60/747

(58) Field of Classification Search ..... 60/776, 60/746, 747
See application file for complete search history.

(56) References Cited

U.S. PATENT DOCUMENTS

| | | | | |
|---|---|---|---|---|
| 3,720,058 | A * | 3/1973 | Collinson et al. | 60/746 |
| 3,938,326 | A | 2/1976 | DeCorso et al. | |
| 4,967,561 | A | 11/1990 | Bruhwiler et al. | |
| 5,289,685 | A | 3/1994 | Hoffa | |
| 5,339,635 | A | 8/1994 | Iwai et al. | |
| 5,361,576 | A | 11/1994 | Muller | |
| 5,713,206 | A | 2/1998 | McWhirter et al. | |
| 5,899,074 | A | 5/1999 | Komatsu et al. | |
| 5,983,643 | A | 11/1999 | Kiesow | |
| 6,272,840 | B1 * | 8/2001 | Crocker et al. | 60/776 |
| 6,360,525 | B1 | 3/2002 | Senior et al. | |
| 6,560,967 | B1 * | 5/2003 | Cohen et al. | 60/776 |
| 6,598,383 | B1 | 7/2003 | Vandervort et al. | |
| 6,928,823 | B2 | 8/2005 | Inoue et al. | |
| 7,117,677 | B2 | 10/2006 | Inoue et al. | |
| 2004/0060301 | A1 | 4/2004 | Chen et al. | |
| 2004/0255589 | A1 | 12/2004 | Yoshida et al. | |
| 2005/0039464 | A1 | 2/2005 | Graf et al. | |

FOREIGN PATENT DOCUMENTS

| | | |
|---|---|---|
| RU | 2197685 C1 | 1/2003 |

OTHER PUBLICATIONS

European Search Report for EP Application No. 05252833.8, dated Aug. 11, 2005.

* cited by examiner

*Primary Examiner*—William H Rodríguez
*Assistant Examiner*—Andrew Nguyen
(74) *Attorney, Agent, or Firm*—Bachman & LaPointe, P.C.

(57) ABSTRACT

A fuel injector has a number of groups of nozzles. The groups are generally concentric with an injector axis. Each nozzle defines a gas flowpath having an outlet for discharging a fuel/air mixture jet. There are means for introducing the fuel to the air. One or more groups of the nozzles are oriented to direct the associated jets skew to the injector axis.

21 Claims, 2 Drawing Sheets

NOZZLE

U.S. GOVERNMENT RIGHTS

The invention was made with U.S. Government support under contract DEFC02-00CH11060 awarded by the U.S. Department of Energy. The U.S. Government has certain rights in the invention.

BACKGROUND OF THE INVENTION (1) Field of the Invention

The invention relates to fuel injectors. More particularly, the invention relates to multi-point fuel/air injectors for gas turbine engines.

(2) Description of the Related Art

A well-developed field exists in combustion technology for gas turbine engines. U.S. patent application Ser No. 10/260,311 (the '311 application) filed Sep. 27, 2002 discloses structure and operational parameters of an exemplary multi-point fuel/air injector for a gas turbine engine. The exemplary injectors of the '311 application include groups of fuel/air nozzles for which the fuel/air ratio of each nozzle group may be separately controlled. Such control may be used to provide desired combustion parameters. The disclosure of the '311 application is incorporated by reference herein as if set forth at length.

Nevertheless, there remains opportunities for improvement in fuel injector construction.

SUMMARY OF THE INVENTION

One aspect of the invention involves a fuel injector apparatus having a number of rings of nozzles. The rings are coaxial with an injector axis. Each nozzle defines a gas flowpath having an outlet for discharging a fuel/air mixture jet. Means introduce the fuel to the air. One or more groups of the nozzles are oriented to direct the associated jets skew to the injector axis.

In various implementations, a first group of the one or more groups may include every nozzle of at least a first of the rings. A first group of the one or more groups may include every nozzle of at least an outermost of the rings. A first group of the one or more groups may include every nozzle of at least a first and a second of the rings. The nozzles of the first and second rings may be oriented to direct their associated jets with an angular component of like sign about the injector axis. The one or more groups may include a first, a second, and a third of the rings. The means may provide at least partially independent control of fuel delivery to a first group of the one or more groups relative to others of the nozzles. The apparatus may be used with a gas turbine engine combustor.

Another aspect of the invention involves a method for engineering such an apparatus. One or more off-longitudinal orientations are selected for respective groups of the one or more groups. At least one performance factor associated with the selected combination is determined so as to achieve a selected performance. The determining may include at least one of software simulation and physical measurement. The determining may comprise determining said performance factor in view of or in combination with fuel/air ratios of the one or more groups at one or more operating conditions. The selecting may be performed so as to achieve a target stabilization of one or more cool zones by one or more hot zones. The at least one performance factor may include levels of UHC, CO, and NOX at one or more power levels.

Another aspect of the invention involves a fuel injector apparatus having a number of nozzles each defining a gas flowpath. The gas flowpaths each have an inlet for receiving air, a port for receiving fuel, and an outlet for discharging a fuel/air mixture jet. One or more groups of nozzles are oriented to direct the associated jets partially tangentially to an overall flowpath from the injector.

In various implementations, the nozzles may be arrayed in a number of concentric groups. The nozzles may be formed in a common injector body.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
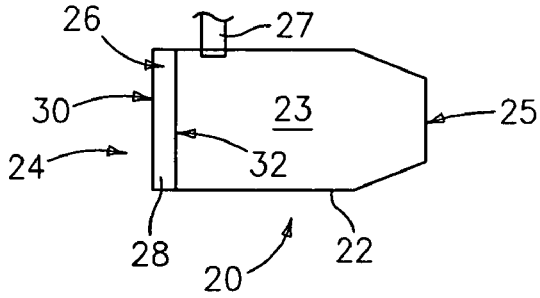
FIG. 1 is a partially schematic sectional view of a gas turbine engine combustor.

FIG. 1 shows a combustor 20 for a gas turbine engine (e.g., an industrial gas turbine engine used for electrical power generation). The combustor has a wall structure 22 surrounding an interior 23 extending from an upstream inlet 24 receiving air from a compressor section of the engine to a downstream outlet 25 discharging combustion gases to the turbine section. Near the inlet, the combustor includes an injector 26 for introducing fuel to the air received from the compressor to introduce a fuel/air mixture to the combustor interior. An ignitor 27 is positioned to ignite the fuel/air mixture.

Figure 2:
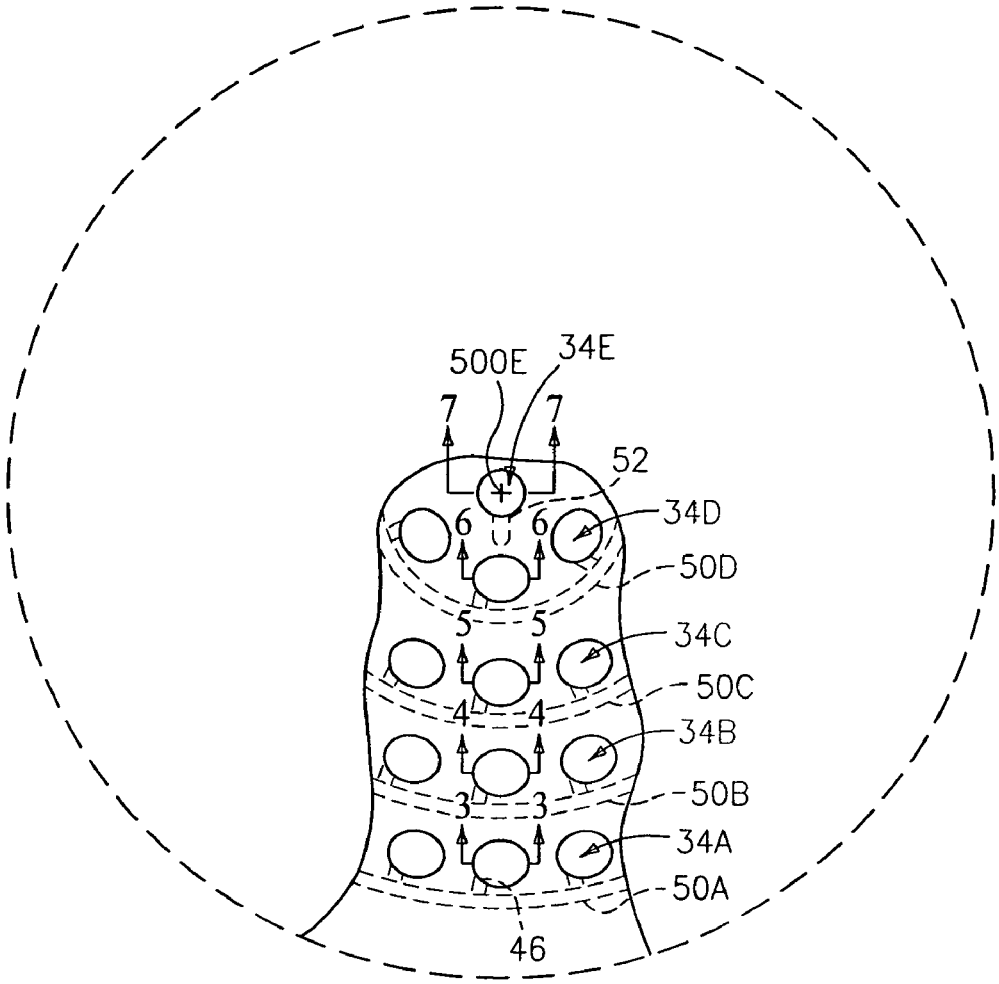
FIG. 2 is a forward-looking view of an aft/downstream end of an injector of the combustor of FIG. 1.
Figure 6:
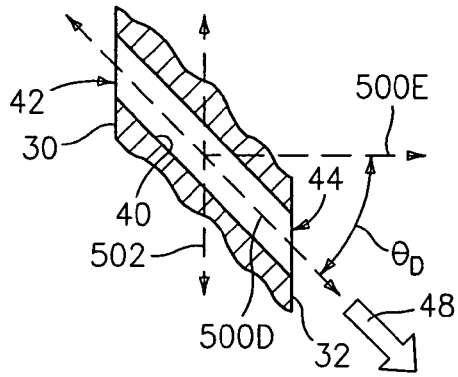
FIG. 6 is a partial sectional view of a fourth nozzle of the injector of FIG. 2 taken along line 6-6.
Figure 5:
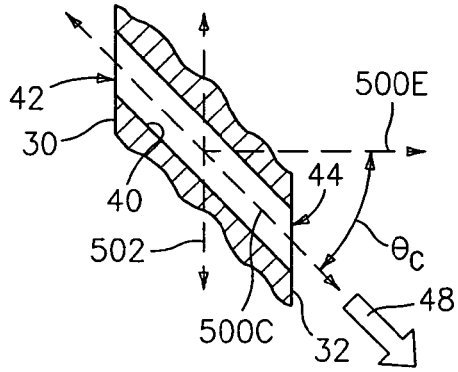
FIG. 5 is a partial sectional view of a third nozzle of the injector of FIG. 2 taken along line 5-5.
Figure 4:
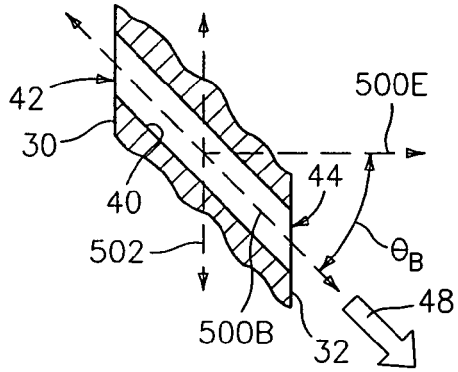
FIG. 4 is a partial sectional view of a second nozzle of the injector of FIG. 2 taken along line 4-4.
Figure 3:
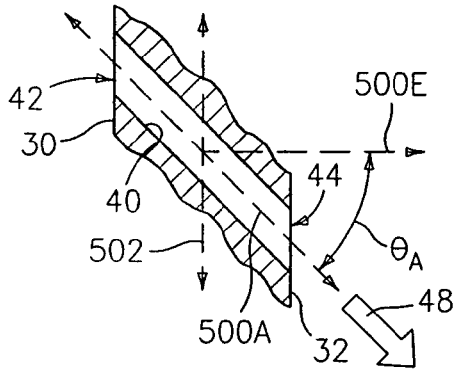
FIG. 3 is a partial sectional view of a nozzle of the injector of FIG. 2 taken along line 3-3.
Figure 7:
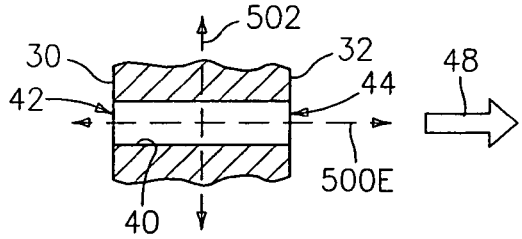
FIG. 7 is a partial sectional view of a fifth nozzle of the injector of FIG. 2 taken along line 7-7.

The injector 26 includes a body 28 extending from an upstream end 30 to a downstream end 32 with a number of passageways therebetween forming associated fuel/air nozzles. FIG. 2 shows passageways 34A-34D arrayed in concentric rings about a single central passageway 34E. The exemplary central passageway has a central axis 500E coincident with a central axis of the body 28. The passageways of at least one of the other rings have central axes off-parallel to the axis 500E. FIGS. 3-6 show the passageways/nozzles 34A-D having respective axes 500A-D skew and off-parallel to the axis 500E (FIGS. 2 and 7) by angles $\theta_A$-$\theta_D$. Each of the passageways is bounded by a surface 40 extending from an upstream air inlet 42 to a downstream fuel/air outlet 44. A fuel inlet port 46 (FIG. 2) is formed in the surface 40 for introducing fuel to the air flowing from the passageway inlet. An associated mixed fuel/air jet 48 is thus expelled from each nozzle along the associated nozzle axis.

One or more groups of the nozzles may be at least partially independently fueled, giving an operator the ability to at least partially vary relative fuel/air ratios of the jets of the groups. In an exemplary embodiment, the nozzles of each ring are commonly fueled independently of the nozzles of the other rings and the central nozzle. For example, the nozzles of each of the rings of nozzles may be fed from an associated fuel plenum 50A-D (FIG. 2) itself fed by an associated fuel line (not shown) with the central nozzle directly fed by another fuel line 52. Each of the lines may have its own independent fuel pump (not shown), pressure regulating valve (not shown), and/or flow control valve (not shown) to controllably govern flow from a fuel source (e.g., a tank—not shown).

The nozzle positioning, size or combination of sizes, and orientations (e.g., angles $\theta_A$-$\theta_D$) may be chosen to achieve desired flow properties at one or more desired operating conditions. The angles may be of the same sign or of opposite sign (e.g., to create a counter-swirl effect). The angles may be of like magnitude or different magnitude. Exemplary angle magnitudes are $\leqq 60°$, more narrowly, 10° -50°, and, most particularly, 20°-45°. In addition to different orientations, the nozzles of each ring (or other grouping) may have different cross-sectional areas, shapes (e.g., beyond the illustrated circular section), or other dimensional parameters. Various layouts/positioning may be used, including non-circular rings or nozzle groups, layouts without a single central nozzle or with a cluster of central nozzles, and the like. In various operational stages, the nozzles of each group may be fueled differently (e.g., as shown in the '311 application) or even the nozzles within a given group may be fueled differently (e.g., shutting fuel flow off to some while maintaining fuel flow to others to further lean the net reaction associated with that group).

The orientation and geometry of the nozzles of each group may be optimized in view of available fuel/air ratios to provide advantageous performance at one or more operating conditions. An exemplary iterative optimization process may be performed in a reengineering of an existing injector. The nozzle orientations and geometries may be iteratively varied. For each iteration, the combination of fuel/air ratios may be varied to establish associated operating conditions. Performance parameters may be measured at those operating conditions (e.g., efficiency, emissions, and stability). The structure and operational parameters associated with desired performance may be noted, with the structure being selected as the reengineered injector configuration and the operational parameters potentially being utilized to configure a control system. Optimization may use a figure of merit that includes appropriately weighted emissions parameters (e.g., of $NO_X$, CO, and unburned hydrocarbons (UHC)) and other performance characteristics (e.g., pressure fluctuation levels), resulting in an optimized configuration that gives the best (or at least an acceptable) combined performance based on these metrics. The degrees of freedom can be restricted to the fuel staging scheme (i.e., how much fuel flows through each of the rings given a fixed total fuel flow) or can be extended to include the swirl angles of each of the rings or the relative air flow rates associated with each of the rings, based on their relative flow capacities. The former is a technique that can be used after the injector is built and can be used to tune the combustor to its best operating point. The latter technique is appropriately used before the final device is built.

Fueling may be used to create zones of different temperature. Relatively cool zones (e.g., by flame temperature) are associated with off-stoichiometric fuel/air mixtures. Relatively hot zones will be closer to stoichiometric. Cooler zones tend to lack stability. Locating a hotter zone adjacent to a cooler zone may stabilize the cooler zone. In an exemplary operation, different fuel/air ratios for the different nozzle rings may create an exemplary three annular combustion zones downstream of the injector: lean, yet relatively hot, outboard and inboard zones; and a leaner and cooler intermediate zone. The outboard and inboard zones provide stability, while the intermediate zone reduces total fuel flow in a low power setting (or range). As $NO_X$ generation is associated with high temperature, the low temperatures of the intermediate zone will have relatively low $NO_X$. By having an overall lean chemistry and good stability, desired advantageously low levels of UHC and CO may be achieved. Increasing/decreasing the equivalence ratio of the intermediate zone may serve to increase/decrease engine power while maintaining desired stability and low emissions.

For such an exemplary three-zone operation, there may be at least three passageways operated at different fuel/air ratios. With more than three independently-fueled nozzle rings (counting a central nozzle, if any), different fuel/air mixtures may facilitate altering the spatial distribution of the three zones or may facilitate yet more complex distributions (e.g., a lean trough within an intermediate rich zone to create more of a five-zone system). Two-zone operation is also possible.

Whereas the foregoing example has an overall lean chemistry exiting the nozzle, other implementations may have overall rich chemistries. A so-called rich-quench-lean operation introduces additional air downstream to produce lean combustion. Such operation may have an intermediate zone exiting the nozzle that is well above stoichiometric and thus also cool. The inboard and outboard zones may be closer to stoichiometric (whether lean or rich) and thus hotter and more stable to stabilize the intermediate zone. As $NO_X$ generation is associated with high temperature, the low temperatures of the intermediate zone (through which the majority of fuel may flow) will have relatively low $NO_X$. The inboard, and outboard zones may represent a lesser portion of the total fuel (and/or air) flow and thus the increase (if any) of $NO_X$ (relative to a uniform distribution of the same total amounts of fuel and air) in these zones may be offset. Yet other combinations of hot and cold zones and their absolute and relative fuel/air ratios may be used at least transiently for different combustor configurations and operating conditions.

With an exemplary combustion of methane fuel in air at 1.0 atm pressure, the flame may otherwise become unstable at equivalence ratios of about equal to or greater than 1.6 for rich and about equal to or less than 0.5 for lean. The cooler zone(s) could be run in these ranges (e.g., more narrowly, 0.1-0.5 or 1.6-5.0). The hotter zone(s) could be run between) 0.5 and 1.6 (e.g., more narrowly 0.5-0.8 or 1.3-1.6, or, yet more narrowly, 0.5-0.6 or 1.5-1.6; staying away from stoichiometric to avoid high flame temperature and, therefore, reduce $NO_X$ formation). Other fuels and pressures could be associated with other ranges.

One or more embodiments of the present invention have been described. Nevertheless, it will be understood that various modifications may be made without departing from the spirit and scope of the invention. For example, when implemented as a redesign/reengineering of an existing injector, details of the existing injector or of the associated combustor may influence details of the particular implementation. More complex structure and additional elements may be provided. In addition to macroscopic swirl provided by the angled nozzles, additional swirl may be imparted to individual jets (e.g., as disclosed in the '311 application). While illustrated with regard to a can-type combustor, other combustor configurations, including annular combustors, may also be possible. Accordingly, other embodiments are within the scope of the following claims.

What is claimed is:

1. A fuel injector apparatus comprising:

a plurality of rings of nozzles, the rings being coaxial with an injector axis, each nozzle defining a gas flow path having an outlet for discharging a fuel/air mixture jet; and means for introducing said fuel to said air, wherein one or more groups of the nozzles are oriented to direct the associated jets along axes non-coplanar, non-intersecting, and non-parallel to the injector axis.

2. The apparatus of claim 1 wherein:

a first group of the one or more groups includes every nozzle of at least a first of said rings.

3. The apparatus of claim 1 wherein:

a first group of the one or more groups includes every nozzle of at least an outermost of said rings.

4. The apparatus of claim 1 wherein:

a first group of the one or more groups includes every nozzle of at least a first and a second of said rings, said nozzles of said first and second rings being oriented to direct their associated jets with an angular component of like sign about the injector axis.

5. The apparatus of claim 1 wherein the one or more groups include a first, a second, and a third of the rings.

6. The apparatus of claim 1 wherein the means provides at least partially independent control of fuel delivery to a first group of the one or more groups relative to others of the nozzles.

7. The apparatus of claim 1 used with a gas turbine engine combustor.

8. A method for engineering a fuel injector apparatus, the apparatus comprising: a plurality of rings of nozzles, the rings being coaxial with an injector axis, each nozzle defining a gas flow path having an outlet for discharging a fuel/air mixture jet; and means for introducing said fuel to said air, wherein one or more groups of the nozzles are oriented to direct the associated jets along axes non-coplanar, non-intersecting, and non-parallel to the injector axis.

the method comprising iteratively: selecting one or more off-longitudinal orientations for respective groups of the one or more groups; and determining at least one performance factor associated with the selected one or more off-longitudinal orientations, so as to achieve a selected performance.

9. The method of claim 8 wherein the determining comprises at least one of:

software simulation; and physical measurement.

10. The method of claim 8 wherein the determining comprises:

determining said performance factor in view of or in combination with fuel/air ratios of the one or more groups at one or more operating conditions.

11. The method of claim 10 wherein the selecting is performed so as to achieve a target stabilization of one or more cool zones by one or more hot zones.

12. The method of claim 8 wherein the at least one performance factor includes levels of UHC, CO, and NOX at one or more power levels.

13. A fuel injector apparatus comprising:

a plurality of nozzles, each defining a gas flow path having:

an inlet receiving air;

a port receiving fuel; and an outlet discharging a fuel/air mixture jet; and wherein one or more groups of the nozzles are oriented to direct the associated jets partially tangentially to a circumference coaxial with an overall flowpath from the injector.

14. The apparatus of claim 13 wherein:

the nozzles are arrayed in a plurality of concentric groups.

15. The apparatus of claim 13 wherein:

the nozzles are arrayed in a plurality of circularly-arrayed concentric groups.

16. The apparatus of claim 13 wherein:

the nozzles are formed in a common injector body.

17. The apparatus of claim 13 wherein:

the nozzles of a first of said groups are operated at a first fuel/air ratio;

the nozzles of a second of said groups, substantially outboard of the first group are fueled at a second fuel/air ratio, greater than the first fuel/air ratio; and the nozzles of a third of said groups, substantially outboard of the second group are fueled at a third fuel/air ratio, less than the second fuel/air ratio.

18. The apparatus of claim 13 operating to provide:

a first combustion zone;

a second combustion zone inboard of the first and leaner than the first; and a third combustion zone inboard of the second and richer than the second.

19. The apparatus of claim 18 wherein the first, second, and third combustion zones are below stoichiometric.

20. The apparatus of claim 1 further comprising:

a central nozzle along the injector axis.

21. A can-type combustor comprising:

a can-type wall structure having an inlet and an outlet and an interior; and the apparatus of claim 1 positioned to introduced a fuel air mixture to the interior.

* * * * *